US010535963B2

(12) United States Patent
Funke

(10) Patent No.: US 10,535,963 B2
(45) Date of Patent: Jan. 14, 2020

(54) ELECTRICAL CONTACT ELEMENT FOR A BUS ELEMENT OF A MOUNTING RAIL BUS SYSTEM

(71) Applicant: Phoenix Contact GmbH & Co. KG, Blomberg (DE)

(72) Inventor: Christian Funke, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/080,024

(22) PCT Filed: Mar. 9, 2017

(86) PCT No.: PCT/EP2017/055570
§ 371 (c)(1),
(2) Date: Aug. 27, 2018

(87) PCT Pub. No.: WO2017/153531
PCT Pub. Date: Sep. 14, 2017

(65) Prior Publication Data

US 2019/0089107 A1 Mar. 21, 2019

(30) Foreign Application Priority Data

Mar. 11, 2016 (LU) ..... 92995

(51) Int. Cl.

| | |
|---|---|
| ***H01R 11/22*** | (2006.01) |
| ***H01R 25/16*** | (2006.01) |
| ***H01R 11/05*** | (2006.01) |
| ***H01R 12/72*** | (2011.01) |
| ***H01R 13/11*** | (2006.01) |

(52) U.S. Cl.
CPC ..... *H01R 25/162* (2013.01); *H01R 11/05* (2013.01); *H01R 12/721* (2013.01); *H01R 13/112* (2013.01)

(58) Field of Classification Search
CPC ..... H01R 13/112
USPC ..... 439/857
See application file for complete search history.

(56) References Cited

U.S. PATENT DOCUMENTS 3,555,497 A * 1/1971 Watanabe ..... H01R 13/112 439/857
3,812,452 A * 5/1974 Sturm ..... H01R 13/112 439/857
5,052,953 A * 10/1991 Weber ..... H01R 12/718 439/637

(Continued)

FOREIGN PATENT DOCUMENTS

DE 4120792 A1 1/1992
DE 102008062578 B3 7/2010

(Continued)

*Primary Examiner* — Neil Abrams
(74) *Attorney, Agent, or Firm* — Leydig, Voit & Mayer, Ltd.

(57) ABSTRACT

An electrical contact element for a bus element of a mounting rail bus system includes: a contact body that extends in an areal manner along an extension plane; and at least one contact leg that is arranged on the contact body and extends along the extension plane. When measured perpendicularly to the extension plane, the contact body has a first thickness and the at least one contact leg has a second thickness that is smaller than the first thickness.

10 Claims, 5 Drawing Sheets

(56) References Cited

U.S. PATENT DOCUMENTS

| | | | | |
|---|---|---|---|---|
| 5,131,874 | A * | 7/1992 | Seido | H01R 13/112 439/636 |
| 5,897,394 | A * | 4/1999 | Adachi | H01R 13/112 439/496 |
| 6,254,440 | B1 * | 7/2001 | Ko | H01R 13/112 439/857 |
| 8,715,015 | B2 * | 5/2014 | Hwang | G01R 1/06722 439/700 |
| 2006/0135003 | A1 | 6/2006 | Peloza | |
| 2012/0178315 | A1 | 7/2012 | Knuettel et al. | |
| 2013/0012076 | A1 | 1/2013 | Hwang | |
| 2013/0109252 | A1 | 5/2013 | Fehling et al. | |
| 2014/0148066 | A1 | 5/2014 | Hagio et al. | |

FOREIGN PATENT DOCUMENTS

| | | | |
|---|---|---|---|
| DE | 102013222390 | A1 | 5/2014 |
| EP | 1575136 | B1 | 5/2007 |
| WO | WO 2012007518 | A1 | 1/2012 |

* cited by examiner

ELECTRICAL CONTACT ELEMENT FOR A BUS ELEMENT OF A MOUNTING RAIL BUS SYSTEM

CROSS-REFERENCE TO PRIOR APPLICATIONS

This application is a U.S. National Phase application under 35 U.S.C. § 371 of International Application No. PCT/EP2017/055570, filed on Mar. 9, 2017, and claims benefit to Luxembourg Patent Application No. LU 92995 filed on Mar. 11, 2016. The International Application was published in German on Sep. 14, 2017 as WO 2017/153531 under PCT Article 21(2).

FIELD

The invention relates to an electrical contact element for a bus element of a mounting rail bus system.

BACKGROUND

A contact element of this kind comprises a contact body that extends in an areal manner along an extension plane, and at least one contact leg that protrudes from the contact body and extends along the extension plane.

A mounting rail may be used for example for mounting various electrical devices, for example electronic devices which assume a control and/or evaluation function, or electrically connecting devices such as series terminals or the like. Electrical devices can be combined with one another in a modular manner on a mounting rail, for example in order to provide electrical functions in the context of an industrial facility.

A mounting rail bus system may be provided in mounting rails of this kind, which system establishes an electrical connection among electrical devices placed on the mounting rail, such that signals, for example control signals, can be exchanged between the electrical devices, and for example a power supply for the electrical devices can also be provided. A mounting rail bus system of this kind is created for example by bus elements that are inserted in the mounting rail and each comprise a plurality of contact elements, via which electrical contact with electrical devices placed on the mounting rail can be established.

An electronic device may for example comprise a circuit board, on which electrical and electronic components for providing electrical and electronic functions, for example control and automation functions, are arranged. If an electronic device of this kind is placed on the mounting rail, the circuit board is intended to electrically contact contact elements of a bus element, via contact pads arranged on the circuit board, such that the electronic device is electrically connected to the mounting rail bus system in this manner. This is intended, if possible, to occur automatically when the electronic device is placed on the mounting rail.

In order to place an electronic device on a mounting rail, the electronic device is placed on the mounting rail by means of a pivot edge of a fastening means for example and is pivoted towards the mounting rail such that the electronic device is latched to the mounting rail by the fastening means and in addition brings a circuit board provided in the electronic device into electrical contact with a bus element of the mounting rail bus system. When the electronic device is pivoted relative to the mounting rail, the circuit board is brought into electrical contact with contact elements of the bus element, such that contact pads of the circuit board come into electrical contact with the contact elements of the bus element.

Electronic devices are also known, however, which can be plugged onto a mounting rail and contact a bus system when plugged on.

There is a need to increase the number of contact elements per bus element, and this requires reducing the structural size of the contact elements. It is therefore desirable in particular to use contact elements that extend in a planar manner along an extension plane, and thus require little installation space in a normal direction perpendicular to the extension plane.

However, it is necessary to ensure, in this case, that contact legs arranged on a contact body of a contact element are sufficiently resilient that, when a circuit board is placed on the contact element, the contact legs can move aside in a suitable manner and can provide a sufficient pressure force for establishing electrical contact when the circuit board has been placed on. In this case it is necessary for a contact leg to be sufficiently resilient but to also be sufficiently sturdy that the contact leg does not (plastically) bend or break when the circuit board is placed on.

A contact element known from EP 1 575 136 B1 extends in a planar manner along an extension plane and comprises contact legs arranged on a contact body, which legs form contact forks for establishing electrical contact with associated mating contact elements.

A contact element known from DE 10 2008 062 578 B3 in the form of a knife receptacle contact is a component of a lead frame and comprises contact legs which together form a contact fork for placement of a mating contact element.

SUMMARY

In an embodiment, the present invention provides an electrical contact element for a bus element of a mounting rail bus system, comprising: a contact body that extends in an areal manner along an extension plane; and at least one contact leg that is arranged on the contact body and extends along the extension plane, wherein, when measured perpendicularly to the extension plane, the contact body has a first thickness and the at least one contact leg has a second thickness that is smaller than the first thickness.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
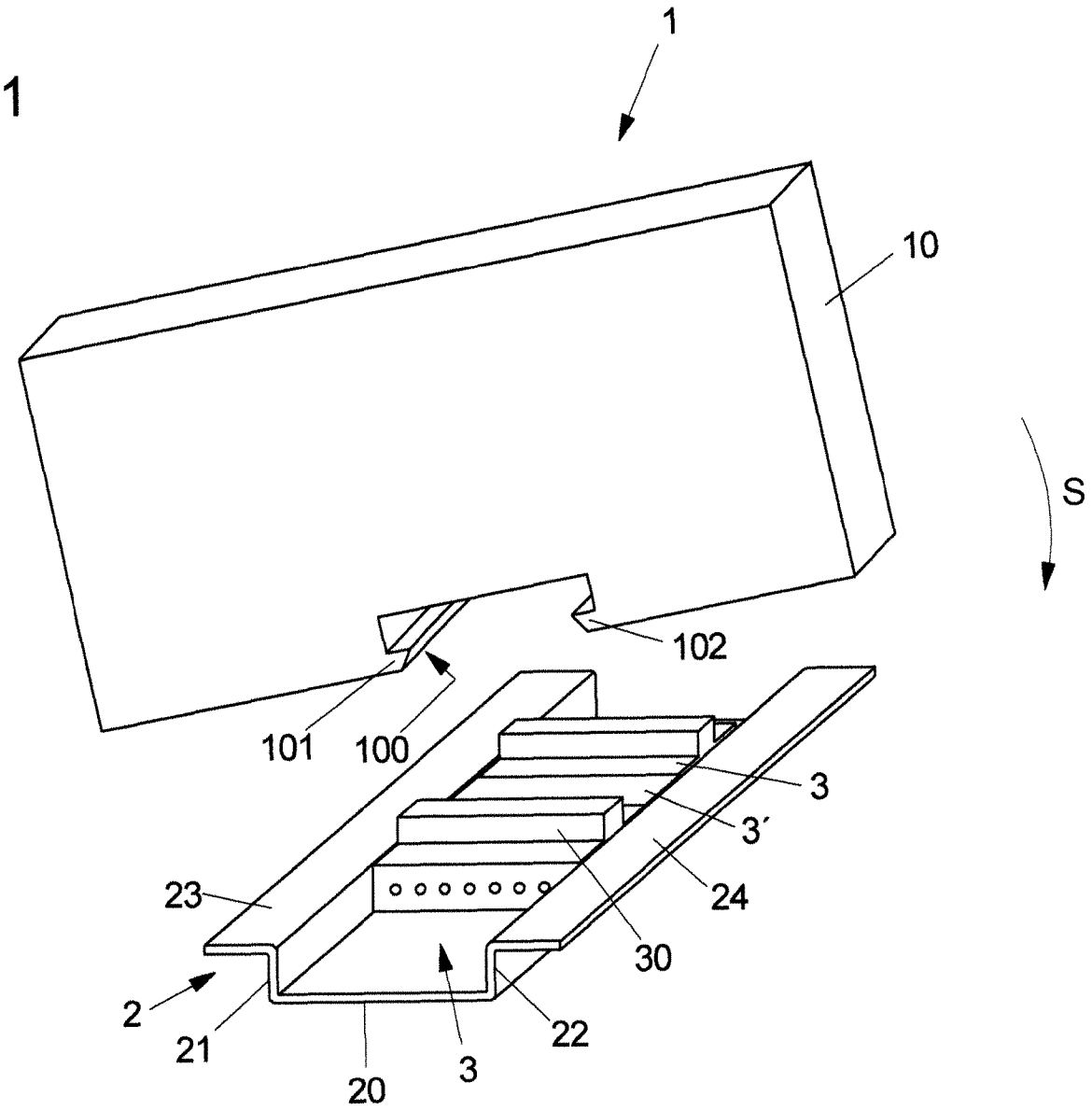
FIG. 1 is a schematic view of an electronic device to be placed on a mounting rail.

In an embodiment, the present provides an electrical contact element for a bus element of a mounting rail bus system, which contact element requires little installation space in a normal direction perpendicular to the extension plane thereof and allows for reliable contact with an associated mating contact element to be established.

According thereto, when measured perpendicularly to the extension plane, the contact body has a first thickness and the at least one contact leg has a second thickness that is smaller than the first thickness.

The contact element extends in a planar manner along the extension plane and may be formed integrally for example, such that one or more contact legs are integrally connected to the contact body and extend from the contact body. The contact legs establish electrical contact with an associated mating contact element, for example one or more contact pads of a circuit board. In order to in this case set the resilience of the contact legs which, just like the contact body, extend in an areal manner along the extension plane, the thickness of the contact legs is adjusted relative to the contact body such that a desired resilience of the contact legs is achieved.

Reducing the thickness increases the resilience of the at least one contact leg.

In the case of the present contact element, the resilience of the contact legs is increased by means of the thickness thereof relative to the contact body being reduced. In this way, a mating contact element can be reliably inserted for example into a contact fork formed by two contact legs, by elastically deforming the contact legs, the resilience of the contact legs being such that, when the mating contact element is inserted, the contact legs can move aside sufficiently, without the contact legs (plastically) bending or breaking, and in addition, when the mating contact element is in the inserted position, the contact legs rest on the mating contact element with a sufficient pressure force that reliable electrical contact with the mating contact element is established.

Various embodiments of the contact element are conceivable.

Thus, in a first variant, the contact element can be formed as a sheet metal punched part that extends in a planar manner along the extension plane. The contact element is thus formed integrally as a punched part and extends in a planar manner along the extension plane without portions being bent and thus projecting out of the extension plane. In this case, the thickness of the at least one contact leg can be set by means of a stamping process, within the context of which the at least one contact leg is stamped to a specified thickness that is reduced relative to the contact body.

For example, the thickness of the contact body may be in a range of between 0.5 mm and 1 mm, for example 0.6 mm. In contrast, the thickness of the at least one contact leg may for example be in a range of between 0.2 mm and 0.8 mm, for example 0.4 mm.

In a second variant, the contact element can be formed as a folded sheet metal punched part. The contact element again extends in a planar manner along the extension plane, but in this case consists of two fold halves that are folded relative to one another, about a fold line, such that the fold surfaces rest areally against one another at least in portions and together form the contact body. In this way, the material thickness can be doubled in particular in the region of the contact body, by means of the fold surfaces being folded together in the region of the contact body. The at least one contact leg is formed by just one fold surface, such that just a single material thickness is present in the region of the contact leg.

For the purpose of manufacture, the contact element according to the second variant can initially be manufactured as a punched element comprising fold halves that are adjacent to one another and extend in a planar manner along the extension plane. Following punching, the fold surfaces are folded together about the fold line in order to complete the contact element.

The contact element comprises one or more contact legs for example, which legs are elastically deformable relative to the contact body in order to allow for reliable placement of one or more mating contact elements. In this case, two contact legs may together form a contact fork in which an associated mating contact element, for example a circuit board comprising contact pads arranged thereon, can be inserted for the purpose of establishing electrical contact. During the insertion process, the contact legs deform elastically in the extension plane and, following insertion of the mating contact element, rest against the mating contact element under a resilient preload (having a force direction extending in the extension plane).

It is conceivable and possible in this case for one contact leg or both contact legs of the contact fork to have a (second) thickness that is smaller than the (first) thickness of the contact body. It may be sufficient for just one of the contact legs to have a reduced thickness, in order to provide increased resilience on this contact leg. However, it is also conceivable and possible, and sometimes advantageous, for both contact legs of a contact fork to have a thickness that is reduced relative to the contact body.

In a specific embodiment, the contact element may also comprise a plurality of contact forks, for example two contact forks, each comprising a pair of contact legs. In this way, a plurality of mating contact elements can be electrically contacted by the contact element. In this case, the contact forks may protrude from the contact body in the same direction. However, it is also conceivable and possible for the contact forks to protrude from the contact body in different directions, such that different mating contact elements can be placed on the different contact forks in different directions.

For example, a first contact fork may make it possible to establish electrical contact with a circuit board and for this purpose may protrude from the contact body in a vertical direction. In contrast, a second contact fork may for example allow for electrical contact to be made with a contact element of another bus element and for this purpose may protrude from the contact body in a horizontal direction that is transverse to the vertical direction.

The contact element may be a component of a bus element of a mounting rail bus system. In order to form the mounting rail bus system, a plurality of bus elements may be arranged so as to be in series with one another in a horizontal direction. For this purpose, the contact elements of every bus element may in each case comprise a contact fork and a contact pin that protrude from the contact body on different sides in the horizontal direction, such that the contact pin of a contact element of a first bus element can for example be inserted into a contact fork of a contact element of an adjacent second bus element for the purpose of establishing electrical contact.

A contact element of the type described here can advantageously be used in a bus element of a mounting rail bus system. However, this should not be taken as limiting. A contact element of the type described here can in principle also be used in components of a very different kind, for example in plug-in connectors for interconnecting electrical cables or the like.

FIG. 1 is a schematic view of an electronic device 1 that comprises a housing 10 and a circuit board 11 (see FIGS. 2A and 2B) arranged therein and that can be designed for example to assume control and/or automation functions within the context of an industrial facility.

The electronic device 1 can be placed on a mounting rail 2, in the form of a top-hat rail, using a fastening means 100 on the bottom of the housing 10 and can be combined with other electrical or electronic devices in order for example to provide an electrical facility formed by modular assemblies within a switch cabinet.

In order to be placed on the mounting rail 2, the housing 10 of the electronic device 1 can be placed on a lateral flange 23 on a limb 21 of the mounting rail 2 by means of a pivot edge 101 of the fastening means 100, and can be pivoted about said pivot edge 101, towards the mounting rail 2, in a pivot direction S, until a locking edge 102 opposite the pivot edge 101 locks together with a flange 24 on a limb 22 of the mounting rail 2 opposite the limb 21, and the electronic device 1 is thus retained on the mounting rail 2 in a form-fitting manner.

In principle, it should be noted in this connection that the electronic device 1 can also be able to be plugged onto the mounting rail 2, i.e. is to be positioned on the mounting rail 2 in a linear insertion direction.

The mounting rail 2 is U-shaped in cross section, comprising a base 20 and opposing limbs 21, 22, each of which are adjoined by a flange 23, 24. The housing 10 of the electronic device 1 is form-fittingly connected to the mounting rail 2, and thus fastened to the mounting rail 2, by means of rear engagement with the lateral flanges 23, 24.

Bus elements 3, 3' of a mounting rail bus system are arranged inside a space of the mounting rail 2 formed between the limbs 21, 22, which bus elements allow for an electrical connection among different electrical and electronic devices that are placed on the mounting rail 2. For this purpose, bus elements 3 comprise an upwardly protruding contacting portion 30 in which the circuit board 11 of the electronic device 1 arranged in the housing 10 can be inserted in order to establish electrical contact with the mounting rail bus system. The bus elements 3 are for example interconnected by means of intermediate elements 3' and can be combined with one another in a modular manner in order to provide a modular mounting rail bus system.

Figure 2A:
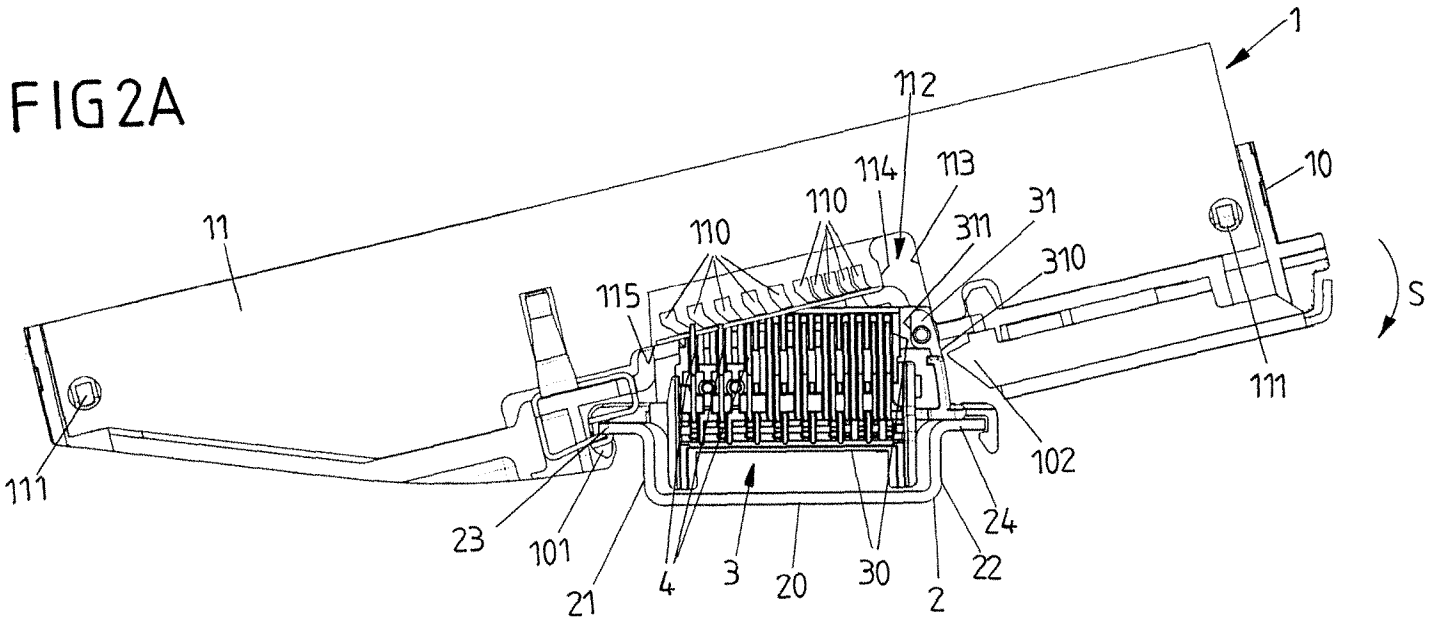
FIG. 2A is a partial sectional view of an electronic device when being placed on a mounting rail.
Figure 2B:
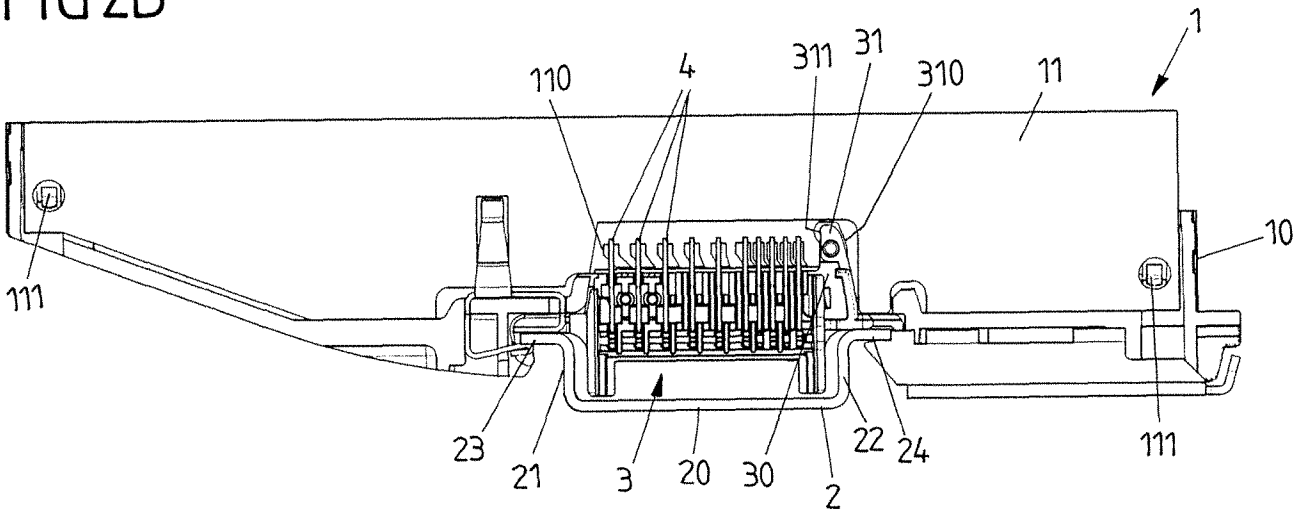
FIG. 2B is a partial sectional view of the electronic device in the position when placed on the mounting rail.
Figure 3B:
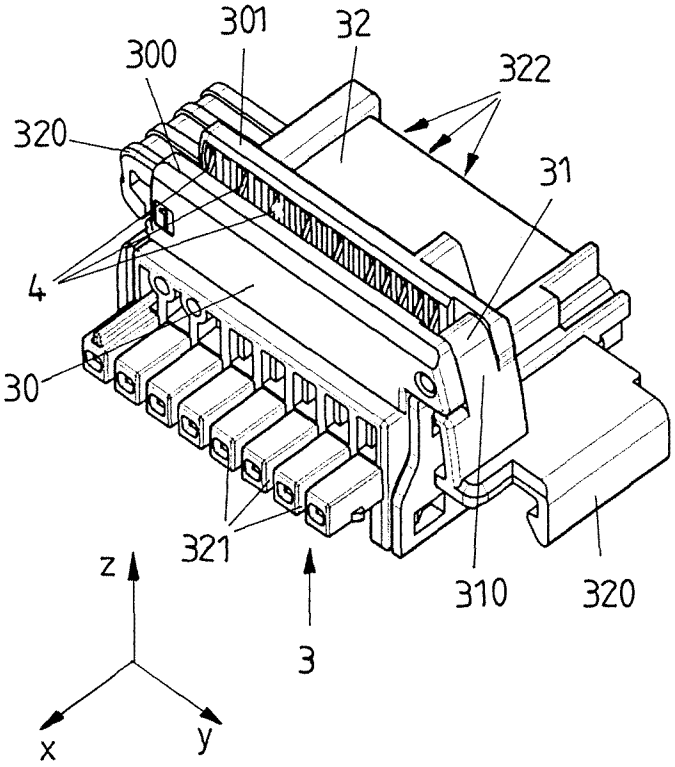
FIG. 3A, 3B are perspective views of a bus element of a mounting rail bus system.
Figure 3A:
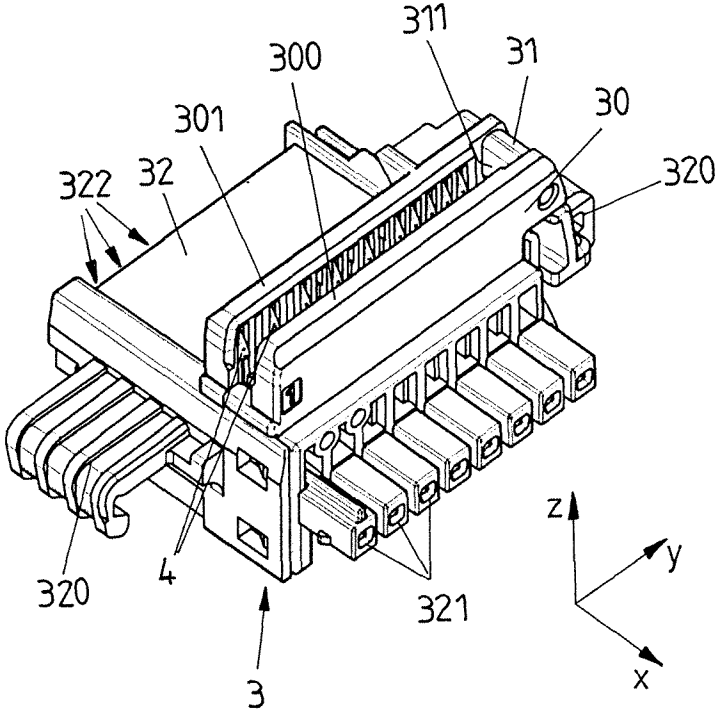

FIGS. 2A, 2B and 3A, 3B show a specific embodiment of a bus element 3 on which an electronic device 1 comprising a circuit board 11 can be placed in an electrically contacting manner. In this case, FIGS. 2A and 2B show the electronic device 1 when being placed on the bus element 3, while FIGS. 3A and 3B are separate perspective views of the bus element 3.

The bus element 3 comprises a plurality of contact elements 4 that are mutually spaced in a transverse direction Y and each extend in a planar manner along an extension plane E, which elements are used for establishing contact with contact pads 110 of the circuit board 11. The extension plane E is spanned by a horizontal direction X and a vertical direction Z, the planar contact elements 4 extending in parallel planes relative to one another.

FIG. 4A to 4C and FIG. 5 show embodiments of contact elements 4. Each contact element 4 comprises a contact body 40 and contact legs 42, 410, 430 that extend therefrom and that are used for establishing electrical contact with other contact elements (contact pin 42 and a contact fork 41 formed by the contact legs 410) or for establishing electrical contact with associated contact pads 110 of the circuit board 11 (a contact fork 43 formed by the contact legs 430).

Figure 4B:
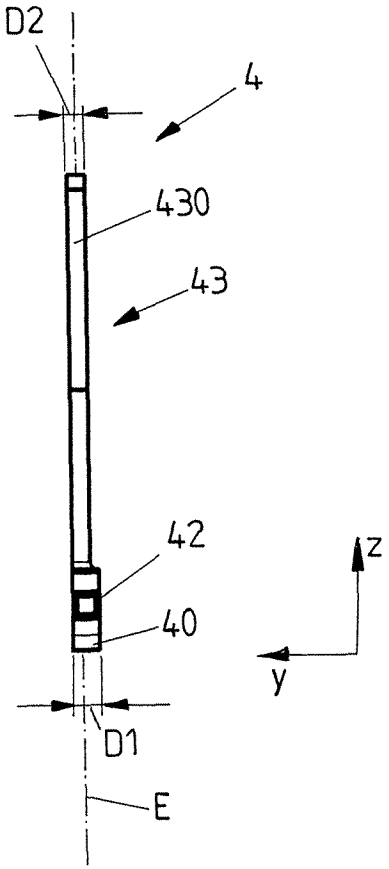
FIG. 4B is a front view of the contact element.
Figure 4A:
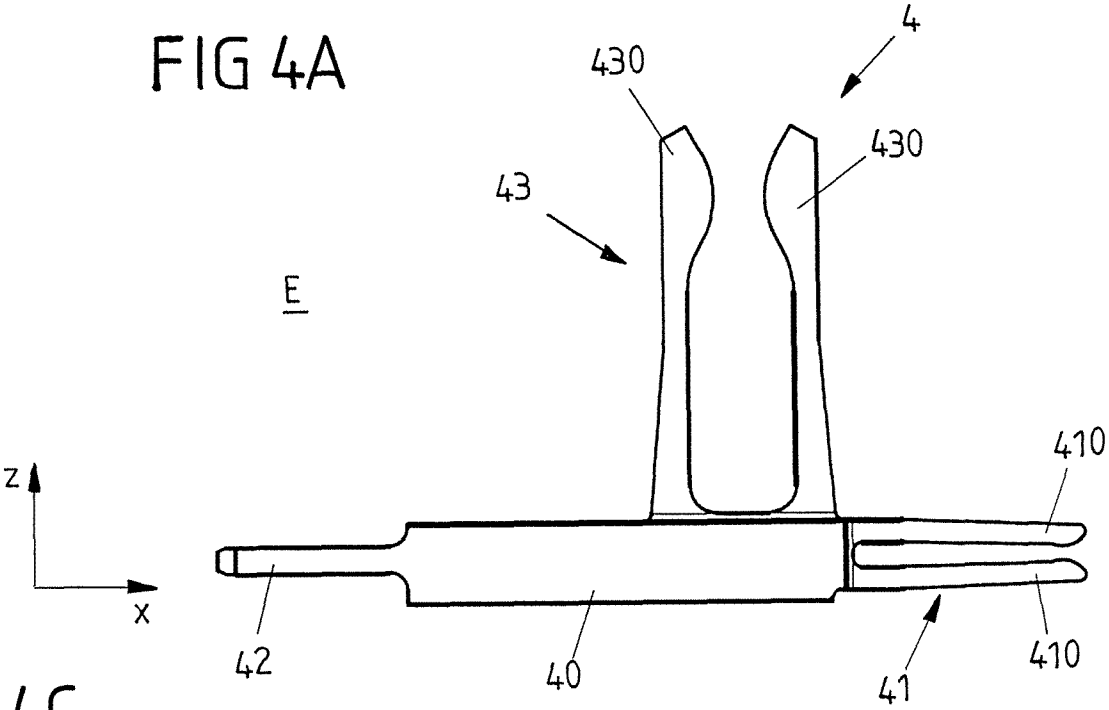
FIG. 4A is a side view of a contact element of a bus element.
Figure 4C:
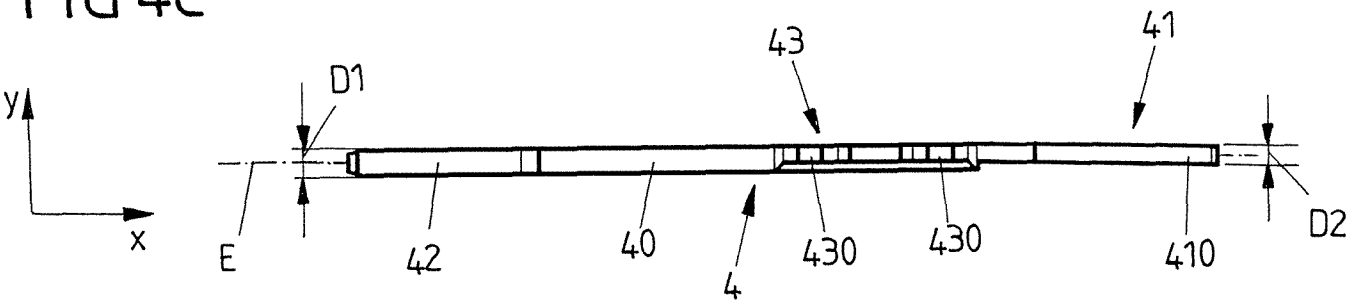
FIG. 4C is a plan view of the contact element.
Figure 5:
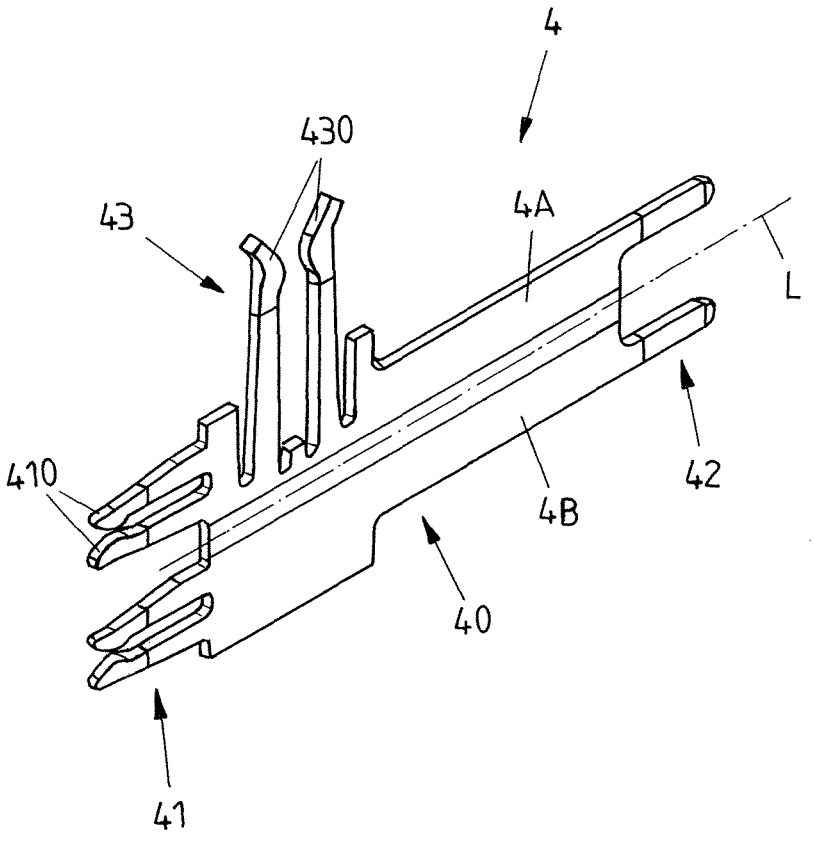
FIG. 5 is a perspective view of another embodiment of a contact element.

Both in the embodiment according to FIG. 4A to 4C and in the embodiment according to FIG. 5, the contact element 4 is formed as an integral sheet metal part. In this case, the contact legs 410 of the contact fork 41, and the contact pin 42, extend from the contact body 40 in the horizontal direction X on different sides in order to establish electrical contact with further contact elements 4 of other bus elements 3, 3'. The contact pin 42 rests in an associated contact stud 321 on a body 32 of the bus element 3, while the contact fork 41 is accessible via contact openings 322 on a rear face of the body 32 that is remote from the contact studs 321.

In contrast, the contact fork 43 formed by the contact legs 430 protrudes from the contact body 40 in the vertical direction Z, and projects into the contacting portion 30 formed by two limbs 300, 301. The circuit board 11 of the electronic device 1, comprising contact pads 110 arranged thereon, can be inserted between the contact legs 430 of the contact fork 43, such that electrical contact between the contact element 4 and associated contact pads 110 of the circuit board 11 can be established by means of the contact legs 430.

The limbs 300, 301 are mutually spaced in the horizontal direction X and form an intermediate space in which the circuit board 11 can be inserted.

Each contact leg 430 of the contact fork 43 is received on a limb 300, 301, such that inserting the circuit board 11 between the limbs 300, 301 causes the circuit board 11 to be pushed between the contact legs 430 of the contact forks 43 of the various contact elements 4 arranged on the bus element 3.

The circuit board 11 comprises a plurality of contact pads 110, congruent contact pads 110 being arranged on either side of the circuit board 11 such that pairs of contact pads 110 are formed that are each assigned to one contact element 4. The contact legs 430 of a contact fork 43 thus contact the associated pair of contact pads 110 on both sides.

The contact legs 430 of the contact fork 43 are intended to establish reliable contact with the associated contact pads 110 of the circuit board 11. For this purpose, the contact legs 430 can be elastically deformed in the extension plane E of the contact element 4, such that, when a circuit board 11 is inserted between the contact legs 430 of the contact fork 43, the contact legs 430 can move aside in a resilient manner in the extension plane E and, when the circuit board 11 has been inserted, said legs rest on the associated contact pads 110 of the circuit board 11 with sufficient pressure force to thereby establish reliable electrical contact.

In order to set the resilience of the contact legs 430, the thickness D2 of the contact legs 430 is reduced relative to the thickness D1 of the contact body 40, such that the resilience of the contact legs 430 is increased relative to the contact body 40 (the resilience of the contact legs 430 in the extension plane E is determined by the areal extension of the contact legs 430 in said extension plane E, by the material thickness, and thirdly by the material properties; when the surface profile is the same, the resilience increases when the material thickness is reduced).

Reducing the thickness D2 of the contact legs 430 relative to the thickness D1 of the contact body 40 makes it possible to increase the resilience, in particular without changing the surface profile of the contact legs 430. (It would alternatively be conceivable, for example, to adjust the resilience of the contact legs 430 for example by lengthening the contact legs 430, but this would be associated with a need for increased installation space.)

The reduced material thickness of the contact legs 430 can be achieved in various ways.

Thus, in the embodiment according to FIG. 4A to 4C, the material thickness of the contact legs 430 is reduced relative to the contact body 40 by means of the contact legs 430 undergoing an additional stamping process, within the context of which the material thickness of the contact legs 430 is reduced by means of stamping. In the embodiment according to FIG. 4A to 4C, the contact element 4 is formed as a sheet metal punched part. After the contact element 4 has been manufactured by punching, the contact legs 430 undergo the additional stamping process, and in this manner the thickness D2 of the contact legs 430 is adjusted in the desired manner.

In contrast, in the embodiment according to FIG. 5, the contact element 4 is formed as a folded sheet metal punched part. The contact element 4, which is shown in FIG. 5 after punching but before folding, comprises fold halves 4A, 4B that are folded together along a fold line L. As a result, the material thickness of the contact element 4 is doubled in the region of the contact body 40 and in the region of the contact pin 42, as well as in the region of the contact legs 410, such that, following folding, the contact legs 430 of the contact fork 43 have a reduced material thickness, in particular relative to the contact body 40.

In the embodiment according to FIG. 4A to 4C, just like the contact legs 430 of the contact fork 43, the contact legs 410 of the contact fork 41 also have a reduced thickness D2. For this purpose, the contact legs 410 also undergo an additional stamping process, advantageously together with the contact legs 430, in order to set the reduced thickness D2.

In contrast, in the embodiment according to FIG. 5, the material thickness of the contact legs 410 of the contact fork 41 is doubled by means of the two fold halves 4A, 4B.

The contact elements 4 are a component of the bus element 3 and are used for establishing electrical contact with further bus elements 3, 3' and in addition for establishing electrical contact with the circuit board 11 of an electronic device 1. In this case, the bus element 3 is fixed to the mounting rail 2 by means of fastening elements 320 in the form of latching elements that protrude laterally from the body 32, by means of the body 32 resting in the space of the mounting rail 2 formed between the limbs 21, 22, and the fastening elements 120 encompassing the lateral flanges 23, 24 on the limbs 21, 22 and thus retaining the bus element 3 on the mounting rail 2 in a form-fitting manner.

In order to place the electronic device 1 on the mounting rail 2, the housing 10 of the electronic device 1 is placed on the lateral flange 23 of the mounting rail 2 by means of the pivot edge 101 of the fastening means 100, as shown in FIG. 2A, and is pivoted towards the mounting rail 2, in the pivot direction S, until the opposing locking edge 102 engages in the flange 24 and the electronic device 1 is thus retained on the mounting rail 2 in a form-fitting manner, as shown in FIG. 2B.

When the electronic device 1 is pivoted towards the mounting rail 2, in the pivot direction S, the circuit board 11 is introduced between the limbs 300, 301 of the contacting portion 30 of the bus element 3. The circuit board 11 is fixed inside the housing 10 of the electronic device 1 in a form-fitting manner by means of fastening points 111, and is thus pivoted together with the housing 10 when the housing 10 is pivoted.

When the circuit board 11 is inserted into the contacting portion 30, pivoting of the housing 10 causes the contact legs 430 of the contact forks 43 of the individual contact elements 4 to slide over the contact pads 110 on the circuit board 11 that are associated in each case. This is achieved with (minor) elastic deformation of the contact legs 430 in particular in the extension plane E, such that, when the circuit board 11 is fully inserted, the contact legs 430 rest on the associated contact pads 110 of the circuit board 11 in a resiliently preloaded manner.

Since the contact elements 4 and the contact pads 110 have comparatively small dimensions, in particular in the transverse direction Y, guide elements 31, 112 are provided on the circuit board 11 and on the bus element 3, which guide elements provide for direct guidance of the circuit board 11 on the bus element 3 when the circuit board 11 is pivoted in. It is thus possible to ensure that the contact elements 4 come into contact with the contact pads 110 of the circuit board 11 and slide along the contact pads 110 in a precise manner.

In particular, in this case the placement of the circuit board 11 on the bus element 3 is independent of any possible tolerances in the fastening between the circuit board 11 and the housing 10 because the direct guidance of the circuit board 11 on the bus element 3 means that the circuit board 11 is inserted into the contacting portion 30 of the bus element 3 in a defined, guided manner.

The guide element 31 on the bus element 3 is arranged between the limbs 300, 301 of the contacting portion 30 and comprises a guide surface 310 that is rounded in part and extends perpendicularly to the vertical direction Z, on the outside thereof, and an inwardly oriented support surface 311 opposite the guide surface 310.

In contrast, the guide element of the circuit board 11 is formed by a recess 112 in the circuit board 11, which recess forms a guide edge 113 and an opposing support edge 114. The recess 112 may be formed for example by milling in the region of a lower edge 115 of the circuit board 11 and is made in the circuit board 11 during the manufacture thereof When the electronic device 1 is placed on the mounting rail 2, pivoting of the housing 10 about the pivot edge 101 brings the guide surface 310 of the guide element 31 of the bus element 3 into sliding contact with the guide edge 113 on the recess 112 of the circuit board 11. When the housing 10 is pivoted in the pivot direction S, the guide surface 310 of the guide element 31 of the bus element 3 slides on the guide edge 113, the guide element 31 and the circuit board 11 being in contact in particular in the region of a lower corner of the guide edge 113. Therefore, when pivoted, the circuit board 11 is guided on the guide element 31 and has a defined position relative to the bus element 3, in particular in the transverse direction Y, ensuring that the contact legs 430 of the contact forks 43 of the contact elements 4 encounter the contact pads 110 of the circuit board 11 in a defined manner.

In the position when placed on, shown in FIG. 2B, the support surface 311 of the guide element 31 of the bus element 3 rests on the support edge 114 within the recess 112 of the circuit board 11 such that the position of the circuit board 11 relative to the bus element 3 is defined even when the electronic device 1 is placed on.

Since the circuit board 11 is pivoted into the contacting portion 30 of the bus element 3 in a guided manner, it is possible in particular to prevent the contact legs 430 of the contact elements 4 from possibly touching the circuit board 11 in addition to associated contact pads 110, which could result in the contact legs 430 digging into the circuit board material. Furthermore, contact legs 430 of a contact fork 43 of a contact element 4 are reliably prevented from being able to come into electrical contact with contact pads 110 that are adjacent to the actually associated contact pads 110.

The basic concept of the invention is not limited to the embodiments described above but can in principle also be implemented in a completely different manner.

For example, the bus element may be in a different form, e.g. having a different number of contacts.

Furthermore, the contact elements may be in a form other than that described here. The number of contact pins and/or contact forks provided on the contact element may also vary.

An electronic device can advantageously be placed on a mounting rail by means of pivoting. However, this is not limiting. In principle it is for example also conceivable and possible for an electronic device to be placed on a mounting rail in a straight placement direction.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 electronic device
10 housing
100 fastening means
101 pivot edge
102 locking edge
11 circuit board
110 contact points
111 fastening points
112 recess
113 guide edge
114 support edge
115 lower edge
2 mounting rail
20 base
21, 22 limb
23, 24 flange
3, 3' bus element
30 contacting portion
300, 301 limb
31 guide element
310 guide surface
311 support surface
32 body
320 fastening elements
321 contact stud
322 contact openings
4 contact element
4A, 4B fold halves
40 contact body
41 contact fork
410 contact leg (fork parts)
42 contact pin
43 contact fork
430 contact leg (fork parts)
D1, D2 thickness
L fold line
S pivot direction

The invention claimed is:

1. An electrical contact element for a bus element of a mounting rail bus system, comprising:

a contact body that extends in an areal manner along an extension plane;

a first contact leg that is arranged on the contact body and extends along the extension plane, the first contact leg comprising two fork parts so as to form a first contact fork;

a second contact leg that is arranged on the contact body and extends along the extension plane, the second contact leg comprising two fork parts so as to form a second contact fork; and a contact pin that extends along the extension plane, wherein, when measured perpendicularly to the extension plane, the contact body and the contact pin have a first thickness, and the first and second contact forks have a second thickness that is smaller than the first thickness.

2. The electrical contact element according to claim 1, wherein at least one of the first contact leg and the second contact leg is formed integrally with the contact body.

3. The electrical contact element according to claim 1, wherein the contact element comprises a sheet metal punched part that extends in a planar manner along the extension plane.

4. The electrical contact element according to claim 3, wherein the thickness of the first and second contact forks is reduced relative to the thickness of the contact body and the contact pin using stamping.

5. The electrical contact element according to claim 1, wherein the contact element comprises a foldable sheet metal punched part that extends in a planar manner along the extension plane and comprises two foldable surfaces that are foldable relative to one another, about a fold line, such that the foldable surfaces, after folding, rest areally against one another at least in portions and together form the contact body.

6. The electrical contact element according to claim 1, wherein at least one of the first contact leg and the second contact leg is elastically deformable with respect to the contact body in order to establish electrical contact with an associated mating contact element.

7. The electrical contact element according to claim 1, wherein the first contact fork and the second contact fork are each configured to receive, between their respective contact legs, an associated mating contact element to establish electrical contact.

8. The electrical contact element according to claim 1, wherein the contact legs of the first and second contact forks protrude from the contact body in different directions.

9. The electrical contact element according to claim 1, wherein the first contact fork is arranged on a first side of the contact body, and wherein the contact pin is arranged on a second side of the contact body that is opposite the first side.

10. A bus element for a mounting rail bus, which bus element can be placed on a mounting rail, the bus element comprising:

the electrical contact element according to claim 1.

* * * * *